United States Patent [19]

Lenhard et al.

[11] Patent Number: 5,037,734

[45] Date of Patent: Aug. 6, 1991

[54] STABILIZED PHOTOGRAPHIC ELEMENT CONTAINING INFRARED SENSITIZING DYE

[75] Inventors: Jerome R. Lenhard, Fairport; Bonnie R. Hein, Macedon, both of N.Y.

[73] Assignee: Eastman Kodak Company, Rochester, N.Y.

[21] Appl. No.: 458,017

[22] Filed: Dec. 28, 1989

[51] Int. Cl.[5] ..... G03C 1/20

[52] U.S. Cl. ..... 430/584; 430/566; 430/570; 430/576; 430/631; 430/637; 430/944

[58] Field of Search ..... 430/944, 584, 576, 570, 430/566, 631, 637

[56] References Cited

U.S. PATENT DOCUMENTS

| | | | |
|---|---|---|---|
| 2,592,368 | 4/1952 | Yackel | 430/264 |
| 4,120,728 | 10/1978 | Ikenoue et al. | 430/631 |
| 4,367,283 | 1/1983 | Nakayama et al. | 430/528 |
| 4,536,473 | 8/1985 | Mihara | 430/575 |
| 4,741,996 | 5/1988 | Aotsuka et al. | 430/559 |
| 4,883,747 | 11/1989 | Grieve et al. | 430/542 |
| 4,917,997 | 4/1990 | Ikeda et al. | 430/572 |

FOREIGN PATENT DOCUMENTS

| | | |
|---|---|---|
| 1124844 | 5/1989 | Japan . |

*Primary Examiner*—Charles L. Bowers, Jr.
*Assistant Examiner*—Janis L. Dote
*Attorney, Agent, or Firm*—Paul L. Marshall

[57] ABSTRACT

A photographic element is described which comprises a silver halide emulsion layer and a bridged tricarbocyanine infrared sensitizing dye which element is stabilized by a combination of an organic reducing agent and a surface active agent. A stabilized photographic silver halide emulsion melt is also described.

25 Claims, No Drawings

STABILIZED PHOTOGRAPHIC ELEMENT CONTAINING INFRARED SENSITIZING DYE

The present invention relates to a stabilized photographic silver halide emulsion and more particularly to an emulsion which is spectrally sensitized in the infrared region of the electromagnetic spectrum. The present invention also relates to a silver halide emulsion melt stabilized against oxidative degradation of infrared light-absorbing sensitizing dye contained therein.

Interest in infrared sensitizing dyes for commercial applications has expanded during the past few years due, at least in part, to application of such dyes in scanning devices. For example, scanners using semi-conductor lasers have the advantage that since they emit infrared radiation, sometimes in the deep infrared (750 to 900 nm), they can be used in the presence of bright lights.

However, a problem has arisen with respect to the stability of silver halide emulsion melts containing infrared sensitizing dyes, especially infrared dyes of the dicarbocyanine, tricarbocyanine, and tetracarbocyanine type. Such dyes when in a solution state before coating, that is the melt state, have been recognized as having a low oxidation potential and, as such, are prone to oxidative decomposition. Dye instability in emulsion melts has caused variable results in both speed and fog levels of subsequently coated photographic emulsions containing such dyes. Conventional stabilizing agents have been found to be ineffective for silver halide emulsion melts containing infrared sensitizing dyes.

One attempt to stabilize a photographic emulsion containing an infrared sensitizing dye, which emulsion is held in a melt state prior to coating, is described in U.S. Pat. No. 4,536,473. This attempt involves adding a water soluble bromide compound to the silver halide emulsion melt containing an infrared sensitizing dye. However, improvements in both photographic speed and reduction in fog are still desirable.

The present invention has as its purpose the provision of a photographic silver halide element comprising a support and a stabilized silver halide emulsion layer, and also the stabilization of a silver halide emulsion melt which comprise an infrared sensitizing dye which does not adversely affect subsequently obtained photographic speed or fog levels.

The present invention provides a photographic element comprising a support and a photographic silver halide emulsion having therein a cyanine infrared-sensitizing dye of the dicarbocyanine, tricarbocyanine or tetracarbocyanine type and a stabilizing combination comprising, per mol of silver, a) from about 0.01 gram to about 5 grams (equivalent in this case to about 1.9 to about 950 moles per mole of sensitizing dye) of an organic reducing agent having an oxidation potential from about +0.10 to about +0.70 volts vs SCE, and b) from 0.25 gram to 50 grams (equivalent to 0.012% to 3% of the gelatin melt volume at the time of addition of the sensitizing dye) of a surface active agent capable of deaggregating the infrared sensitizing dye.

The present invention also provides a stabilized silver halide emulsion melt comprising a dicarbocyanine, tricarbocyanine, or tetracarbocyanine infrared-sensitizing dye and, per mole of silver, a) from about 0.01 gram to about 5 grams of an organic reducing agent having an oxidation potential from about +0.10 to about +0.70 volts v SCE, and b) from 0.25 gram to 50 grams (equivalent to 0.012% to 3% of the gelatin melt volume at the time of addition of the sensitizing dye) of a surface active agent capable of deaggregating the infrared sensitizing dye.

The level of from about 0.01 gram to about 5 grams or organic reducing agent per mole of infrared sensitizing dye is equivalent to about 1.9 to about 950 moles of reducing agent per mole of sensitizing dye.

The organic reducing agent, in order to be effective in the stabilization of an infrared sensitizing dye in an emulsion melt, must have an oxidation potential of about +0.10 to about +0.70 volt. Where the reducing agent has a potential lower than about +0.10 the agent itself is not sufficiently stable and can cause increased photographic fog. Where the reducing agent has a potential higher than about +0.70 volts it is too weak to prevent the infrared dye from undergoing oxidative decomposition in the emulsion melt.

The oxidation potential is measured by cyclic voltammetry. The reducing agent is dissolved in 1 ml of methanol and diluted with 9 ml of water containing 0.1M sodium phosphate buffer at pH=5.5. Oxygen is removed from the solution by passing nitrogen gas through the solution for 10 minutes prior to measurement. A platinum disk is used for the working electrode, a platinum wire used for the counter electrode, and a saturated calomel electrode (SCE) for the reference electrode. Measurement is conducted at 25° C. using a potential sweep rate of 0.1 V/sec. The oxidation potential is taken as the peak potential of the cyclic voltammetric wave.

Reflectance spectra taken from different emulsion melts show spectral bands that correspond to the dye in the region of 800 to 900 nm, whereas aggregated dye has a spectral band of about 680 to about 800 nm and oxidized dye has a spectral band of about 500 to about 600 nm.

The preferred oxidation potential of organic reducing agents employed in this invention is from about +0.10 to about +0.55 volt. When utilized in conjunction with a surface active agent, as described, the desired level of stabilization is obtained. The most preferred oxidation potential is from about +0.20 to about +0.50. Protection from oxidative decomposition of infrared sensitizing dye in an emulsion melt prevents loss of photographic speed and generation of undesirable fog in subsequently coated emulsion layers.

The amount of organic reducing agent which is employed in this invention may range from as little as about 0.01 gram to as much as about 5 grams per mol of silver. Where the reducing agent has a relatively lower potential it is a stronger oxidizing agent and relatively less agent need be employed. Dihydroanhydropiperdinohexose reductone and ascorbic acid are particularly preferred reducing agents.

Conversely, where the reducing agent has a relatively higher potential it is a weaker oxidizing agent and a larger amount thereof, per mol of dye, is employed.

A preferred range of concentration for the organic reducing agent per mole of silver is from about 0.01 gram to about 2 grams. A most preferred range of reducing agent is from about 0.05 gram to about 0.3 grams per mol of silver.

Specific examples of organic reducing agents which meet the above oxidation requirements are listed below:

| Compound | Oxidation Potential |
|---|---|
| Ascorbic Acid | +0.45 |
| dihydroanhydropiperidino-hexose reductone | +0.225 |
| Piperidino hexose reductone | +0.525 |
| 4-methyl-4 hydroxy-methyl-1-phenyl-3-pyrazolidone | +0.675 |
| Hydroquinone | +0.660 |

Surface active agents which are useful in this invention can be nonionic, anionic or cationic so long as the agent which is used is capable of deaggregating the infrared sensitizing dye in the gelatin melt. Surfactants are commonly used as coating aids, or for other purposes such as for emulsion dispersion, antistatic purposes or prevention of adhesion. Such uses differ from that described in the present invention in that here the surface active agent is added to the melt at the time of dye addition for the purpose of deaggregating the infrared sensitizing dye. The amount of surface active agent that is employed in this invention may range from as little as 0.25 gram per mole of silver (equivalent to 0.012% of melt volume at time of addition of the sensitizing dye) to as much as about 50 grams per mole of silver (equivalent to 3% by volume of melt at time of dye addition). A preferred range for the surfactant is from about 2 gram to about 20 grams per mole of silver (0.1% to 1.0% by volume of melt) at the time of sensitizing dye addition. A most preferred range of surfactant is from about 4 grams to about 14 grams of surfactant per mole of silver (equivalent to 0.2% to about 0.7% by volume of the gelatin melt). Where attempts are made to impart stability to the infrared sensitizing dye melts using a reducing agent but without using a surface active agent as described, the desired stability is not realized. Reducing agents as those listed above are not very effective at preventing the oxidation of sensitizing dye if the dye exists in various aggregated states. The desired degree of stabilization is only achieved if the reducing agent and surfactant are used in combination. Conversely, use of a surface active agent as described but without using a reducing agent also fails to impart stabilization to the dye composition. This is illustrated below.

A preferred surface active agent is nonionic. Most preferred agents include those having an aliphatic or an aromatic moiety and an alkylene oxide moiety such as represented by the following formulae:

$$R-(OCH_2CH_2)_nOH, \quad a)$$

$$R-(CH\underset{O}{\frown}CH)_n-CH_2CH_2OH \quad (b)$$

-continued $$R-O(CH_2\underset{\underset{CH_2OH}{|}}{C}HO)_nH \quad (c)$$

wherein:

R is alkyl, cycloalkyl, aryl, alkaryl or aralkyl and n is an integer. The alkylene oxide chain length represented by n can be from 1 to 30. Excellent stabilization results can be obtained when n is from about 8 to about 15.

Typical surfactants which can be employed in this invention include:

1. Triton ®X-100, reported to be a polyoxyethylene substituted t-octylphenol sold by the Rohm and Haas Company of Philadelphia, Pa.

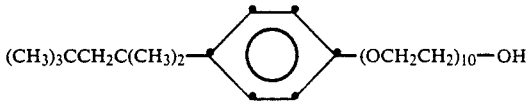

2. Surfactant 10G ®, reported to be

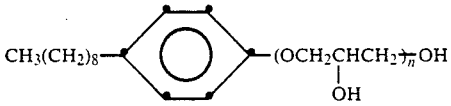

3. Igepal ®, reported to be

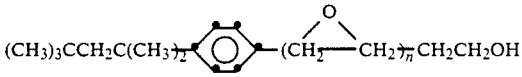

As noted above, infrared sensitizing dyes which can be stabilized in accordance with this invention include essentially all low oxidation potential dicarbocyanine, tricarbocyanine and tetracarbocyanine dyes, or combinations thereof, which are prone to oxidation in silver halide emulsion melts. Low oxidation potential infrared dyes are those dyes that have reversible one-electron oxidation potentials in acetonitrile determined by the technique of phase-selective second-harmonic AC voltammetry as described in *J. Imag. Sci.*, 1986, Vol. 30, p 27, that are less than about 0.60 V vs the Ag/AgCl reference electrode. Such dyes are described in one or more of the following references:

U.S. Pat. Nos. 2,095,854; 2,095,856; 2,734,900; 2,955,939; 3,482,978; 3,552,974; 3,573,921; 3,582,344; Hamer, Cyanine Dyes and Related Compounds, John Wiley & Sons, 1964, as well as in Mees, THE THEORY OF THE PHOTOGRAPHIC PROCESS, 3rd Ed. (MacMillan, 1966), pp 198–201. The synthesis of such dyes is within the level of skill in the art.

Low oxidation-potential cyanine dyes which can be stabilized in accordance with the present invention include those which are represented by the following general formula:

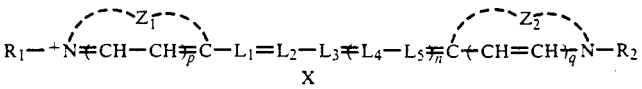

wherein:

$R_1$ and $R_2$, each independently represents substituted or unsubstituted alkyl;

$Z_1$ and $Z_2$ each independently represents the atoms necessary to complete a substituted or unsubstituted 5- or 6-membered heterocyclic nucleus, $L_1$, $L_2$, $L_3$, $L_4$ and $L_5$ each independently represents a substituted or unsubstituted methine group;

X represents a counterion as necessary to balance the charge of the dye molecule;

p and q each independently represents 0 or 1; and n represents 1, 2 or 3 or, when p and q are both 1, represents 0.

According to the above formula, $Z_1$ and $Z_2$ each independently represents the atoms necessary to complete a substituted or unsubstituted 5- or 6-membered heterocyclic nucleus. These include a substituted or unsubstituted thiazole nucleus, nucleus, quinoline nucleus, tellurazole nucleus, pyridine nucleus, or thiazoline nucleus. This nucleus may be substituted with known substituents, such as halogen (e.g., chloro, fluoro, bromo), alkoxy (e.g., methoxy, ethoxy), alkyl, thioalkyl, aryl, aralkyl, sulfonate, and others known in the art.

Specific 5 or 6 membered nitrogen-containing rings which represent the aforesaid $Z_1$ or $Z_2$ nuclei include benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naptho[1,2-d]thiazole, naphtho[2,3-d]thiazole, 5-methoxynaphtho-[1,2-d]thiazole, 7-ethoxynaphtho-[2,1-thiazole, 8-methoxynaphtho[2,1-d]thiazole, 5-methoxynaphtho[2,3-d]thiazole, benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-]selenazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 4,6-dimethylbenzoxazole, 5-ethoxybenzoxazole, naphtho[2,1-d]oxazole, naphtho[1,2-d]oxazole, naphtho[2,3-d]oxazole, 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, chloroindolenine, etc.), an imidazole nucleus (for example, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethylnaphtho[1,2-d]imidazole, pyridine, 5-methyl-2-pyridine, 3-methyl-4-pyridine, a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, 8-fluoro-4-quinoline, etc.; a tellurazole nucleus, e.g., benzotellurazole, naphtho[1,2-d]tellurazole, 5,6-dimethoxytellurazole, 5-methoxytellurazole, 5-methyltellurazole; a thiazoline nucleus, e.g., thiazoline, 4-methylthiazoline, etc.

$L_1$–$L_5$ may be unsubstituted, i.e., —CH=, or substituted with known substituents such as alkyl, aryl, heterocyclic groups, halogen, and the like.

In addition, these methine groups may also be substituted with aryl (e.g., phenyl). Additionally, substituents on the methine groups may form bridged linkages. For example, $L_2$, $L_3$ and the adjacent $L_4$ methine group (where $n=1-3$) may be bridged to form a 6-membered substituted or unsubstituted carbocyclic ring. Similarly, $L_3$, $L_4$ and $L_5$ may be bridged to form a 5- or 6-membered substituted or unsubstituted carbocyclic ring, where $L_4$ is preferably substituted with alkyl or aryl, $L_2$, $L_3$ and $L_5$ and the adjacent three methine groups (where $n=2$) may be bridged to form a 10-membered fused substituted or unsubstituted carbocyclic ring, or $L_1$ and $L_5$ may, together with $R_1$ and $R_2$, respectively, form a 5- or 6-membered ring structure.

Where $n=2$, substituents for $L_4$ may also include those of the structure:

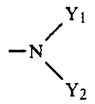

wherein $Y_1$ and $Y_2$ each represents a substituted or unsubstituted alkyl group having from 1 to 18 carbon atoms, in the alkyl moiety, (e.g., a methyl group, an ethyl group, a propyl group, a butyl group, a benzyl group, a phenylethyl group, etc.) or a substituted or unsubstituted aryl group containing from 6 to 18 carbon atoms, e.g., a phenyl group, a naphthyl group, a tolyl group, a p-chlorophenyl group, etc., or $Y_1$ and $Y_2$, along with the nitrogen atom, may be bonded together to form a 5- or 6-membered nitrogen-containing heterocyclic ring.

Also useful as L groups are equivalents of methine groups, such as a heterocyclic nitrogen atom when the methine chain linking the cyanine-type heterocycles includes, for example, a rhodanine ring.

$R_1$ and $R_2$ may be substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., β-hydroxyethyl, 1-hydroxybutyl, etc., an alkoxyalkyl group, e.g., β-methoxyethyl, 1-butoxybutyl, etc., a carboxyalkyl group, e.g., β-carboxyethyl, 1carboxybutyl, etc.; a sulfoalkyl group, e.g., β-sulfoethyl, 1-sulfobutyl, etc., a sulfatoalkyl group, e.g., β-sulfatoethyl, 1-sulfatobutyl, etc., an acyloxyalkyl group, e.g., β-acetoxyethyl, γ-acetoxypropyl, 1-butyryloxbutyl, etc., an alkoxycarbonylalkyl group, e.g., β-methoxycarbonylethyl, 1-ethoxycarbonylbutyl, etc., or an aralkyl group, e.g., benzyl, phenethyl, etc., a carbamoyl group, a sulfamoyl group, or, any aryl group, e.g., phenyl, tolyl, naphthyl, methoxyphenyl, chlorophenyl, etc. Alkyl and aryl groups may be substituted by one or more of the substituents exemplified above.

X represents a counterion as necessary to balance the charge of the dye molecule. The counterion may be ionically complexed to the molecule or it may be part of the dye molecule itself to form a intramolecular salt. Such counterions are well-known in the art. For example, when X is an anion (e.g., when $R_1$ and $R_2$ are unsubstituted alkyl), examples of X include chloride, bromide, iodide, p-toluene sulfonate, methane sulfonate, methyl sulfate, ethyl sulfate, perchlorate, and the like. When X is a cation (e.g., when $R_2$ and $R_2$ are both sulfoalkyl or carboxyalkyl), examples of X include sodium, potassium, triethylammonium, and the like.

Dyes of the above formula are advantageously used to sensitize photographic silver halide emulsions to infrared radiation. Such emulsions can contain grains of any known silver halides, such as silver chloride, silver bromide, silver bromoiodide, and the like, or mixtures thereof as described in *Research Disclosure*, Item 17643, December 1978, published by Kenneth Mason Publications, Ltd., The Old Harbourmaster's, 8 North Street, Emsworth, Hampshire PO10 7DD, ENGLAND, the disclosures of which are incorporated herein by reference. This publication will be identified hereafter by the term "Research Disclosure No. 1." Section I. The silver halide grains may be of any known type such as spherical, cubic or tabular grains, as described in *Research Disclosure*, Item 22534, January 1983, the disclosures of which are incorporated herein by reference. This publication will be identified hereafter by the term "Research Disclosure No. 2".

Examples of specific infrared sensitizing dyes which can be stabilized in accordance with the present invention are set forth in Tables I to IX below.

TABLE I

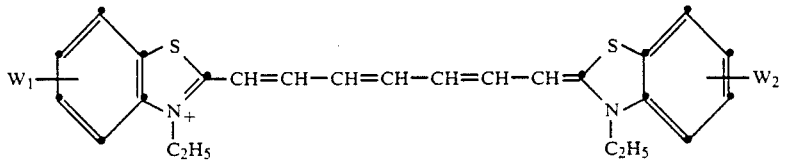

| Dye | $W_1$ | $W_2$ |
|---|---|---|
| 1 | H | H |
| 2 | 5,6-$SCH_3$ | 5,6-$SCH_3$ |
| 3 | 5,6-$SCH_3$ | 4,5-Benzo |
| 4 | 4,5-Benzo | 4,5-Benzo |

TABLE II

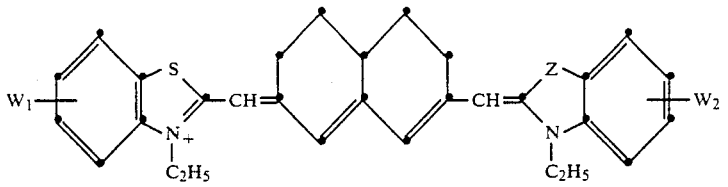

| Dye | $W_1$ | $W_2$ | Z |
|---|---|---|---|
| 5 | H | H | S |
| 6 | 5-$SCH_3$ | 5-$SCH_3$ | S |
| 7 | 5,6-$SCH_3$ | 5,6-$SCH_3$ | S |
| 8 | 4,5-Benzo | 4,5-Benzo | S |
| 9 | H | H | O |
| 10 | 5-$SCH_3$ | 5-$SCH_3$ | O |
| 11 | H | 4,5-Benzo | O |

TABLE III

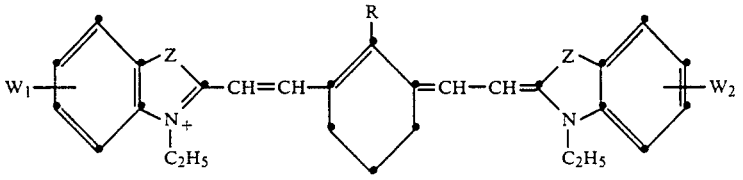

| Dye | R | $W_1$ | $W_2$ | Z |
|---|---|---|---|---|
| 12 | $CH_3$ | H | H | S |
| 13 | $CH_3$ | 4,5 Benzo | 4,5-Benzo | S |
| 14 | $C_6H_5$ | H | H | S |
| 15 | $C_6H_5$ | 4,5 Benzo | 4,5-Benzo | S |
| 16 | $CH_3$ | 5,6-$SCH_3$ | 5,6-$SCH_3$ | S |

TABLE III-continued
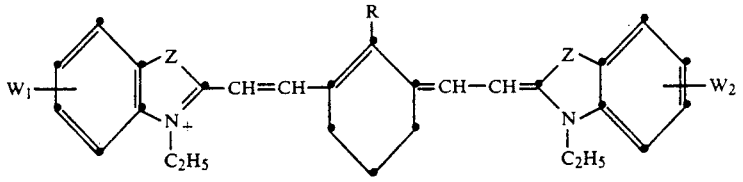
| Dye | R | $W_1$ | $W_2$ | Z |
|---|---|---|---|---|
| 17 | Cl | 5,6-$CH_3$ | 5,6-$CH_3$ | O |
TABLE IV
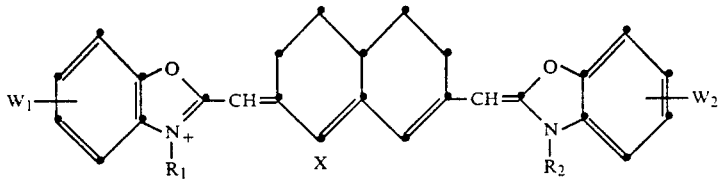
| Dye | $W_1$ | $W_2$ | $R_1$ | $R_2$ |
|---|---|---|---|---|
| 18 | H | H | $C_2H_5$ | $C_2H_5$ |
| 19 | 5,6-Benzo | 5,6-Benzo | $C_2H_5$ | $C_2H_5$ |
TABLE V
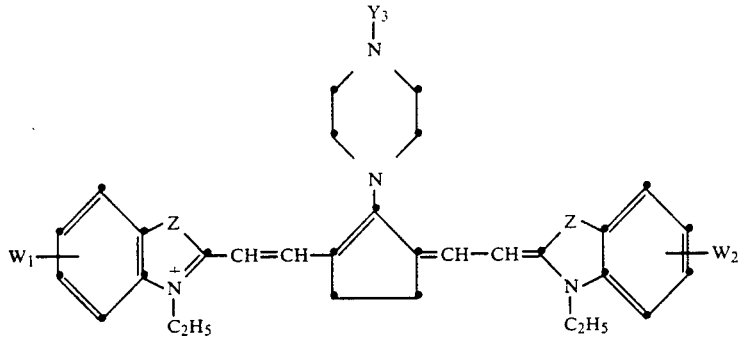
| Dye | $W_1$ Z | $W_2$ | $Y_3$ | |
|---|---|---|---|---|
| 20 | H | H | $CO_2C_2H_5$ | S |
| 21 | 5,6-$SCH_3$ | 5,6-$SCH_3$ | $CO_2C_2H_5$ | S |
| 22 | 5-$SCH_3$ | 5-$SCH_3$ | $CO_2C_2H_5$ | S |
| 23 | 5,6-$SCH_3$ | 5,6-$SCH_3$ | $CO_2C_2H_5$ | O |
TABLE VI
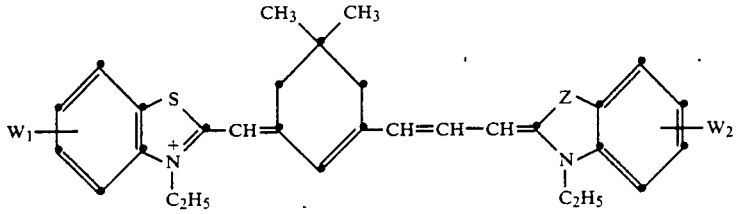
| Dye | $W_1$ | $W_2$ | Z |
|---|---|---|---|
| 24 | H | H | S |
| 25 | 5,6-$SCH_3$ | 5,6-$SCH_3$ | S |
| 26 | 5-6-$SCH_3$ | H | O |

TABLE VII
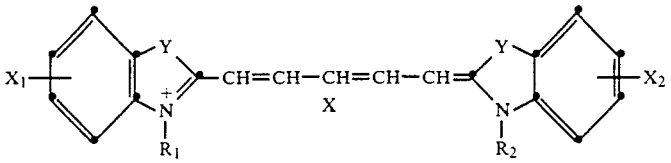
| Dye | Y | $X_1$ | $X_2$ | $R_1$ | $R_2$ |
|---|---|---|---|---|---|
| 27 | Se | 5,6-$OCH_3$ | 5,6-$OCH_3$ | $C_2H_5$ | $C_2H_5$ |
| 28 | Te | H | H | $CH_3$ | $CH_3$ |
| 29 | Se | H | H | $C_2H_5$ | $C_2H_5$ |
TABLE VIII
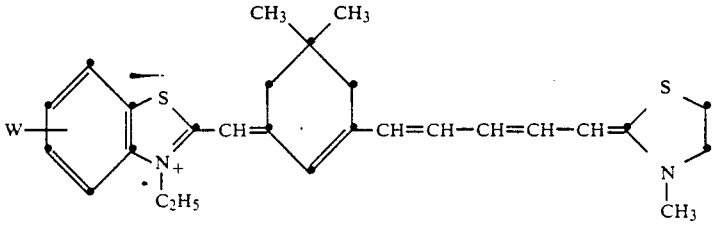
| Dye | W |
|---|---|
| 30 | 5,6-$SCH_3$ |
| 31 | 5,6-$OCH_3$ |
TABLE IX
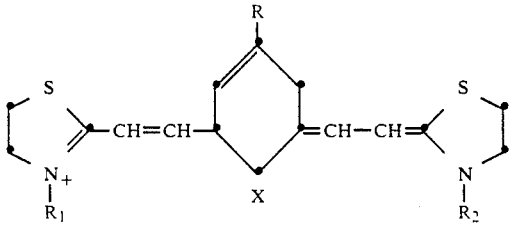
| Dye | R | $R_1$ | $R_2$ |
|---|---|---|---|
| 32 | $C_2H_5$ | $CH_3$ | $CH_3$ |
| 33 | $CH_3$ | Sp | Sp |
Dye 34
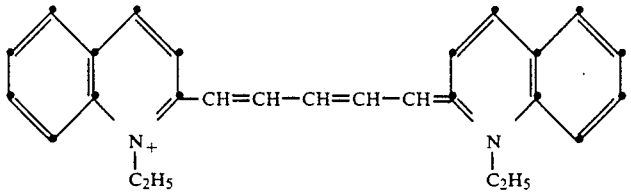
Dye 35
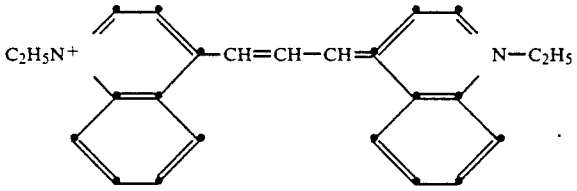
Dye 36
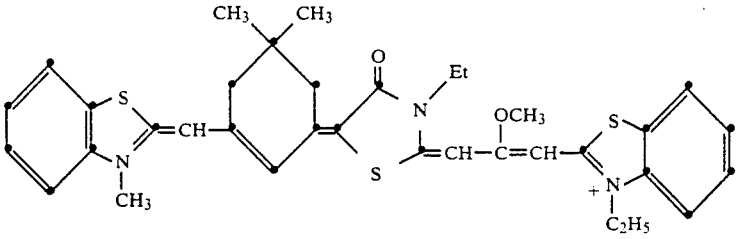

TABLE IX-continued

Dye 37

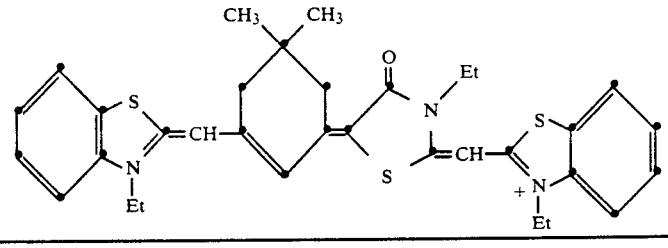

Sp = 3-sulfopropyl
Et = ethyl
SMe = thiomethyl

The silver halide emulsions generally include a hydrophilic vehicle for coating the emulsion as a layer of a photographic element. Useful vehicles include both naturally-occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), and others described in *Research Disclosure No. I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure No. I.* The vehicle can be present in the emulsion in any amount known to be useful in photographic emulsions.

In a preferred embodiment, the silver halide emulsion sensitized with a dye of formula (I) also contains a bis-azine compound. The bis-azines useful in the invention are well-known in the art as supersensitizers for red- or infrared-sensitive silver halide emulsions. They include compounds according to the formula:

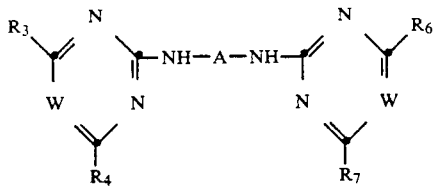

(III)

wherein:

W represents nitrogen or —$CR_5$=, where $R_5$ is hydrogen, halogen (e.g., chloro, bromo, etc.), or alkyl (preferably of from 1 to 4 carbon atoms, e.g., methyl, ethyl, etc); and where $R_3$, $R_4$, $R_6$, and $R_7$ each independently represents hydrogen, hydroxy, alkoxy (preferably having from 1 to 10 carbon atoms, e.g., methoxy, ethoxy, propoxy, etc.), alkyl (preferably having from 1 to 10 carbon atoms, e.g., methyl, ethyl, n-butyl, isopropyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (wherein the alkyl moiety preferably has from 1 to 10 carbon atoms, e.g., methylthio, ethylthio, etc.), a heterocyclothio group (e.g., benzothiazolylthio, etc.), an arylthio group (e.g., phenylthio, tolylthio, etc.), an amino group, an alkylamino group, which term includes an unsubstituted and a substituted alkylamino group such as a hydroxy or sulfo-substituted alkylamino group (preferably an alkylamino group or substituted alkylamino group wherein the alkyl moiety has from 1 to 10 carbon atoms, e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group, which term includes an unsubstituted arylamino group and a substituted arylamino group, preferably a substituted arylamino group wherein the substituent is an alkyl group of from about 1 to 4 carbon atoms, a sulfo group, a carboxy group, a hydroxy group, and the like (e.g., anilino, o-sulfoanilino, m-sulfoanilino, p-sulfoanilino, o-anisylamino, m-anisylamino, p-anisylamino, o-toluidino, m-toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridyl-amino, etc.), an aryl group (e.g., phenyl, etc), or a mercapto group, where $R_3$, $R_4$, $R_6$ and $R_7$ may each be the same as or different from one another.

Also according to the bis-azine formula (III), A represents a divalent aromatic residue, preferably comprising 1 to 4 aromatic rings. Such residues are known in the art and are described, for example, in U.S. Pat. No. 4,199,360, the disclosure of which is incorporated herein by reference.

The emulsions of this invention can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure No.* 1, and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure No.* 1 and references cited therein.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chillset or dried, or both. Drying may be accelerated by known techniques such as conduction, convection, radiation heating, or a combination thereof.

The photographic elements can be coated on a variety of supports as described in Research Disclosure, Section XVII and the references described therein.

The photographic element of the invention can be black and white or color. Since the photographic element is sensitive to infrared radiation, which is invisible to the human eye, a color element would be a false color sensitized element, with one or more infrared-sensitive layers having one or more dye-forming couplers associated therewith. Such an element is described, for example, in U.S. Pat. No. 4,619,892. Color dye-forming couplers and the various addenda associated therewith are well-known in the art and are described, for example, in *Research Disclosure No.* 1.

The following examples described in more detail the operation of the present invention. However, these examples are not to be construed as in any way limiting the invention.

EXAMPLE 1

Relative melt stabilities of infrared sensitizing dyes were assessed by reflectance spectrophotometry. The melt consisted of a 0.35 μm AgCl emulsion (1.8 kg/mole, pH-4.8) that was doctored with 500 mg/mole of supersensitizer (structure A), 150 mg/mole of the antifoggant 1-(3-acetomidophenyl)-5-mercaptotetrazole sodium salt, and 1 mole percent of potassium bromide. Also added to the melt before dye addition was 200 mg/mole Ag (equivalent to 38 moles per mole of sensitizing dye) of ascorbic acid and 2 g/mole Ag (0.1% by volume of melt) of the surfactant 10 G. The infrared sensitizer Dye 15 (Table III above) was then added to the emulsion melt at 0.03 mmole/mole Ag from a methanol solution. The dyed melt concentrate was held for 3 minutes at 40° C. to facilitate dye adsorption, then a volume of 4.3% gelatin was added to give a final emulsion that contained 270 grams of gel per mole of silver.

Reflectance spectra of this emulsion melt and of a comparison melt that contained no added ascorbic acid or surfactant 10 G were measured from 900 nm to 450 nm. For the emulsion containing no ascorbic acid or surfactant the reflectance spectrum indicated the presence of monomeric dye (800 nm–900 nm), aggregated dye (680 nm–800 nm), and oxidized dye (radical dication, 500 nm–600 nm). Spectra recorded for the emulsion containing the ascorbic acid and surfactant show a substantial increase in the reflection density associated with the dye (at 885 nm) from 0.46 to 0.68-log reflectance and a concomitant decrease in the magnitude of the oxidized-dye reflectance band (at 675 nm) from 0.40 to 0.27-log reflectance. Similar comparisons made on these emulsion melts held at 40° C. for over 3 hours confirm that the stability of the sensitizing dye is greatly improved by the presence of the ascorbic acid/surfactant combination. The observed benefits in sensitizing dye melt stability when the reducing agent ascorbic acid and surfactant 10 G are present cannot be achieved if one or the other of the reducing agent or surfactant is omitted.

EXAMPLE 2

Photographic evaluation was carried out in the following photographic element, coated on a clear poly(ethyleneterephthalate) support: the image layer contained a silver chloride emulsion (0.3 mm), and an infrared spectral sensitizing dye (Dye 13) at 0.3 mmoles per mole Ag. The emulsion was doctored with 500 mg/mole Ag of supersensitizer (structure A), 150 mg/mole Ag of a substituted phenylmercaptotetrazole antifoggant, 1200 mg/mole Ag of potassium bromide, adjusted to a vAg of 125 mV and a pH of 4.7 before further doctoring with 200 mg/mole Ag of the reducing agent (ascorbic acid) and 0.5% by volume of the surface active agent 10 G. Dye was added to the emulsion after all doctoring was completed and before the introduction of additional gelatin. Additional gelatin was added and the entire mixture was incubated at 40° C. for 3.5 hours before it was coated. The emulsion was coated at 215 mg/m$^2$ of Ag with gelatin at 5.38 g/m$^2$.

Comparison coatings were prepared with dye, supersensitizer, and other doctors and handled as stated above but contained no reducing agent or surface active agent.

To determine the degree of desensitization by the reducing agent and surface active agent, the coatings were exposed for 9.9 seconds on a wedge spectrographic instrument utilizing a Corning #3850 (360 nm) cutoff filter to effectively expose the element to a wavelength range from 360 to 720 nm. To determine the spectral speed increases by the dye in the presence of reducing agent and surface active agent, the coatings were exposed for 10.4 seconds on a wedge spectrographic instrument utilizing a Kodak WR89B (700 nm) cutoff filter to effectively expose the element to a wavelength range from 700 to 1000 nm. The instrument contains a tungsten light source and a step tablet ranging in density from 0 to 3 density units in 0.3 density steps. All elements were then processed in Dektol for 2 minutes.

Comparison of photographic data obtained for the coatings prepared with and without reducing agent and surface active agent indicates that the presence of reducing agent and surface active agent results in a relative speed gain of 0.45 log E at the wavelength of maximum spectral sensitivity of the dye (ca. 860 nm). This substantial gain in relative spectral speed was accompanied by only very minor relative changes in fog and desensitization levels.

Structure A

-continued

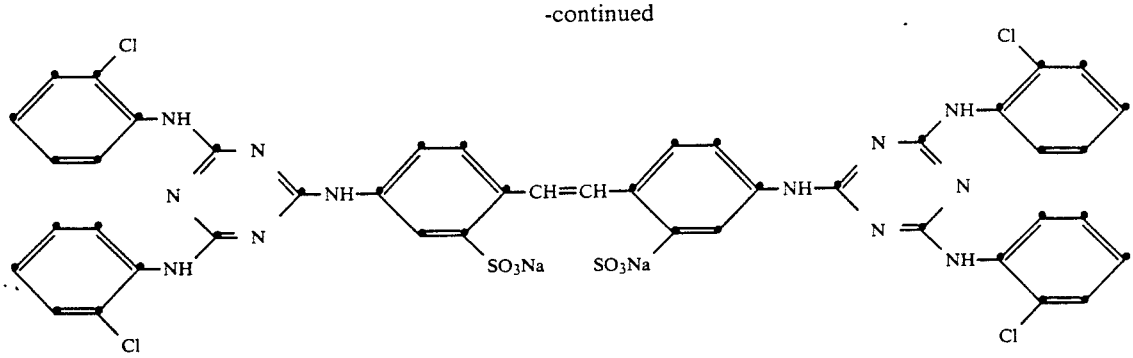

The invention has been described in detail with reference to preferred embodiments thereof but it will be understood that variations and modifications can be effected within the spirit and scope of the invention.

We claim:

1. A photographic silver halide emulsion comprising an infrared sensitizing dye of the tricarbocyanine type and a stabilizing combination comprising per mole of silver, (a) from about 0.01 gram to 5 grams of an organic reducing agent having an oxidation potential of from about +0.10 to about 0.70 V vs SCE, and (b) from 0.25 gram to 50 grams of a nonionic surface active agent capable of deaggregating the infrared sensitizing dye, wherein said dye is represented by the formula:

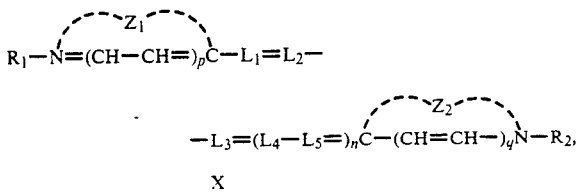

wherein $Z_1$ and $Z_2$ each represents non-metallic atoms necessary for completing a 5-membered or 6-membered substituted or unsubstituted nitrogen-containing heterocyclic nucleus;

$R_1$ and $R_2$, which may be the same or different, substituted or unsubstituted, represent an alkyl, alkoxy, alkoxycarbonyl or acyl group having from 1 to 8 carbon atoms; acyloxy having from 1 to 3 carbon atoms; carbamoyl; sulfamoyl; aryl or aryloxy group having from 6 to 10 carbon atoms;

$L_1$, $L_2$, $L_3$, $L_4$ and $L_5$ each independently represents a substituted or unsubstituted methine group, such that $L_4$, and $L_5$ are bridged to form a 5- or 6-membered substituted or unsubstituted carbocyclic ring;

X represents a counterion as necessary to balance the charge of the dye molecule;

p and q each independently represents 0 or 1; and n represents 2.

2. The emulsion according to claim 1 wherein the organic reducing agent has an oxidation potential of from +0.10 to +0.55 V.

3. The emulsion of claim 1 wherein the organic reducing agent has an oxidation potential of from about +0.20 to +0.50.

4. The emulsion of claim 1 which comprises from about 0.01 gram to about 2 grams of an organic reducing agent per mole of silver.

5. The emulsion of claim 1 which comprises from about 0.05 gram to about 0.3 gram of an organic reducing agent per mole of silver.

6. The emulsion of claim 1 which comprises 1.9 moles to about 950 moles of organic reducing agent per mole of dye.

7. The emulsion of claim 1 wherein the organic reducing agent is at least one of ascorbic acid and dihydroanhydropiperidino hexose reductone.

8. The emulsion of claim 1 wherein the organic reducing agent is at least one of piperidino hexose reductone and 4-methyl-4hydroxy-methyl-1-phenyl-3-pyrazolidone.

9. The emulsion of claim 8 wherein the surface active agent has one of the formulae:

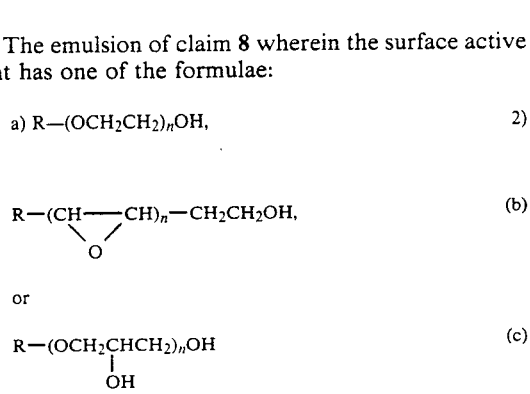

wherein

R is alkyl, cycloalkyl, aryl, alkaryl or aralkyl, and n is an integer of from 8 to about 15.

10. The emulsion of claim 1 which comprises from about 2 to about 20 grams of surface active agent.

11. The emulsion of claim 1 which comprises from about 4 to about 14 grams of surface active agent.

12. The emulsion of claim 1 wherein the surface active agent has at least one of the formulae:

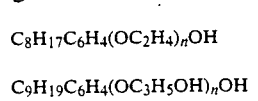

where n is 10.

13. The emulsion of claim 12 wherein the organic reducing agent is ascorbic acid.

14. The emulsion of claim 12 wherein the organic reducing agent is dihydroanhydropiperidino hexose reductone.

15. The emulsion of claim 1 wherein $Z_1$ and $Z_2$ each independently represents the atoms necessary to complete a substituted or unsubstituted 5- or 6-membered imidazole nucleus, thiazole nucleus, oxazole nucleus, selenazole nucleus, quinoline nucleus, tellurazole nucleus, pyridine nucleus, or thiazoline nucleus.

16. The emulsion of claim 15 wherein the heterocyclic nuclei represented by $Z_1$ and $Z_2$ are each independently unsubstituted or substituted with halogen (e.g., chloro, fluoro, bromo), alkoxy (e.g., methoxy, ethoxy), alkyl, thioalkyl, aryl, aralkyl or sulfonate.

17. The emulsion of claim 1 wherein the infrared sensitizing dye has a reversible one-electron oxidation potential that is less than 0.60 V vs the Ag/AgCl reference electrode.

18. The emulsion of claim 1 wherein wherein n=2 and $L_4$ is substituted with a substituent with the structure

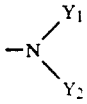

wherein $Y_1$ and $Y_2$ each represents a substituted or unsubstituted alkyl group having from 1 to 18 carbon atoms, in the alkyl moiety, (e.g., a methyl group, an ethyl group, a propyl group, a butyl group, a benzyl group, a phenylethyl group, etc.) or a substituted or unsubstituted aryl group containing from 6 to 18 carbon atoms, e.g., a phenyl group, a naphthyl group, a tolyl group, a p-chlorophenyl group, etc., or $Y_1$ and $Y_2$, along with the nitrogen atom, may be bonded together to form a 5- or 6-membered substituted or unsubstituted nitrogen-containing heterocyclic ring.

19. The emulsion of claim 1 which also comprises a bis-azine compound.

20. A photographic silver halide emulsion coating melt comprising an infrared sensitizing dye of the tricarbocyanine type and a stabilizing combination comprising per mole of silver, (a) from about 0.01 gram to 5 grams of an organic reducing agent having an oxidation potential of from about +0.10 to about 0.70 V vs SCE, and (b) from 0.25 gram to 50 grams of a nonionic surface active agent capable of deaggregating the infrared sensitizing dye, wherein said dye is represented by the formula:

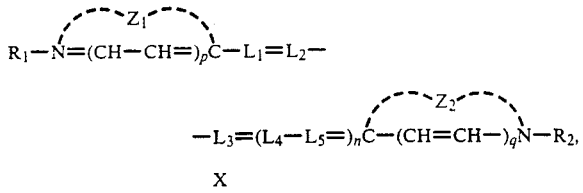

wherein $Z_1$ and $Z_2$ each represents non-metallic atoms necessary for completing a 5-membered or 6-membered substituted or unsubstituted nitrogen-containing heterocyclic nucleus;

$R_1$ and $R_2$, which may be the same or different, substituted or unsubstituted, represent an alkyl, alkoxy, alkoxycarbonyl or acyl group having from 1 to 8 carbon atoms; acyloxy having from 1 to 3 carbon atoms; carbamoyl; sulfamoyl; aryl or aryloxy group having from 6 to 10 carbon atoms;

$L_1$, $L_2$, $L_3$, $L_4$ and $L_5$ each independently represents a substituted or unsubstituted methine group, such that $L_3$, $L_4$, and $L_5$ are bridged to form a 5- or 6-membered substituted or unsubstituted carbocyclic ring;

X represents a counterion as necessary to balance the charge of the dye molecule;

p and q each independently represents 0 or 1; and n represents 2.

21. The coating of claim 19 wherein the organic reducing agent has an oxidation potential of from +0.10 to +0.55 V.

22. The coating of claim 19 wherein the emulsion comprises from about 0.01 gram to about 2 grams of an organic reducing agent per mole of silver.

23. The coating of claim 19 wherein the emulsion comprises 1.9 moles to about 950 moles of organic reducing agent per mole of dye.

24. The coating of claim 19 wherein the organic reducing agent is at least one of piperidino hexose reductone and 4-methyl-4hydroxy-methyl-1-phenyl-3-pyrazolidone.

25. The coating of claim 19 wherein the sensitizing dye has the following structural formula:

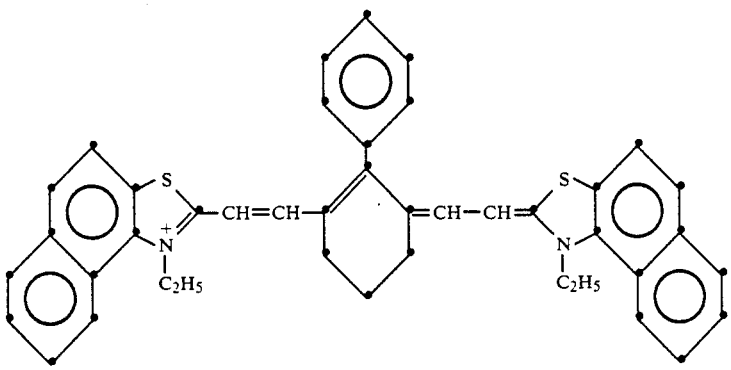

* * * * *

UNITED STATES PATENT AND TRADEMARK OFFICE

CERTIFICATE OF CORRECTION

PATENT NO. : 5,037,734

DATED : August 6, 1991

INVENTOR(S) : Jerome R. Lenhard, et al

It is certified that error appears in the above-identified patent and that said Letters Patent is hereby corrected as shown below:

Column 17, line 54, before "$L_4$," insert -- $L_3$, -- .

Signed and Sealed this

Twenty-second Day of June, 1993

*Attest:*

Michael K. Kirk

MICHAEL K. KIRK

*Attesting Officer*

*Acting Commissioner of Patents and Trademarks*